United States Patent [19]

Aitken, Jr.

[11] 4,063,716

[45] Dec. 20, 1977

[54] PORTABLE MIXING DEVICE

[76] Inventor: Malcolm T. Aitken, Jr., R.D. No. 3, Saratoga Springs, N.Y. 12866

[21] Appl. No.: 740,674

[22] Filed: Nov. 10, 1976

[51] Int. Cl.[2] ..... B28C 5/16

[52] U.S. Cl. ..... 366/100; 366/48; 366/281

[58] Field of Search ..... 259/178 R, 178 A, 179, 259/102, 111, 118, 183, 64, 40, 21, 5; 99/348

[56] References Cited

U.S. PATENT DOCUMENTS

| | | | |
|---|---|---|---|
| 3,357,685 | 12/1967 | Stephens | 99/348 |
| 3,482,823 | 12/1969 | Rechtin | 259/102 |
| 3,810,605 | 5/1974 | Lambert | 99/348 |

*Primary Examiner*—Robert W. Jenkins

*Attorney, Agent, or Firm*—Cushman, Darby & Cushman

[57] ABSTRACT

A mixer is provided having a main frame and adjustable means for supporting the frame on the edges of a container. The frame serves as a mounting for a motor and a drive assembly, the latter converting rotation of the motor into simultaneous rotation of mixing blades and movement of the blades in an orbital path.

11 Claims, 2 Drawing Figures

PORTABLE MIXING DEVICE

BACKGROUND OF THE INVENTION

There are a number of occasions when it is necessary to mix modest quantities of materials for various uses. For example, in construction projects, cement, concrete, plaster, asbestos cement or the like are mixed on-site, and in the agricultural field, feed mixtures also are often prepared in limited amounts. A conventional manner of producing such mixes is to place the materials to be blended in a wheelbarrow and then agitate them, using hand tools.

Of course, such manual mixing is tedious, and therefore, attempts have been made in the past to simplify matters by the use of powered mixers adapted to operate on materials within the wheelbarrow. For example, U.S. Pat. No. 3,820,763, which granted to Charles Questi, et al on June 28, 1974, provides a self-supporting mixer to which a wheelbarrow is moved in order that the contents may be mixed. Also U.S. Pat. No. 2,744,835, which issued to Blaine G. Selvage on May 8, 1956, relates to a device which is permanently secured to a wheelbarrow for mixing purposes. However, these prior art arrangements suffer one or more important shortcomings, such as lack of portability, unsuitability for use with wheelbarrows of different sizes, inconsistent mixing characteristics, difficult removal of the mixed material from the wheelbarrow, etc.

OBJECT OF THE INVENTION

The present invention is intended to overcome the deficiencies of prior art devices by providing a portable light-weight mixer which is particularly adapted to be temporarily secured to wheelbarrows of varying sizes and which provides uniform mixing of the contents of the wheelbarrow.

SUMMARY OF THE INVENTION

The improved mixer includes a support arrangement for a motor and a drive assembly the support being secured to edges of the wheelbarrow. Mixing blades are joined to the drive assembly so as to be simultaneously rotated and moved in an orbital path whereby uniform agitation of the mixture is achieved.

DETAILS OF THE INVENTION

Figure 1:
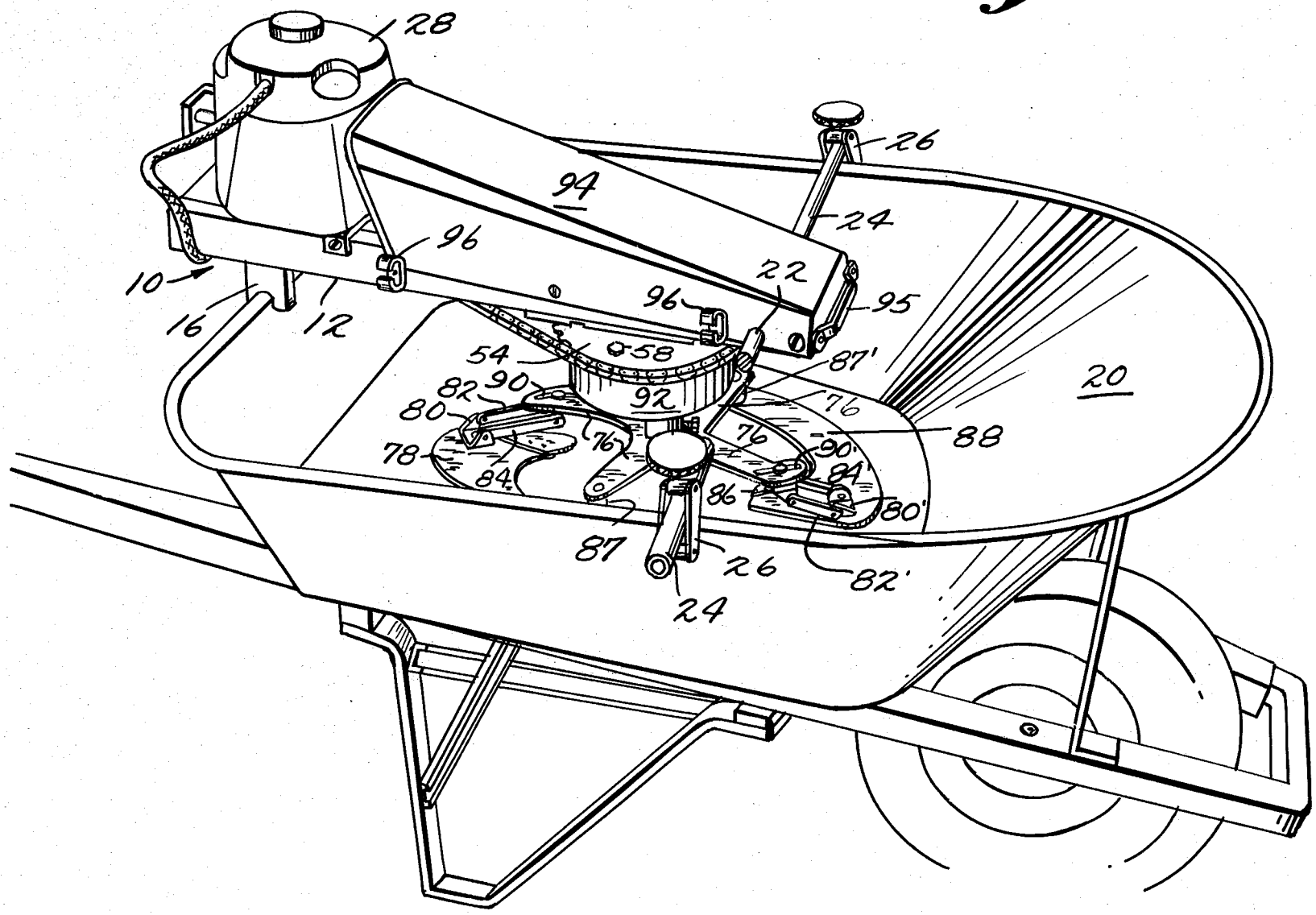
Figure 2:
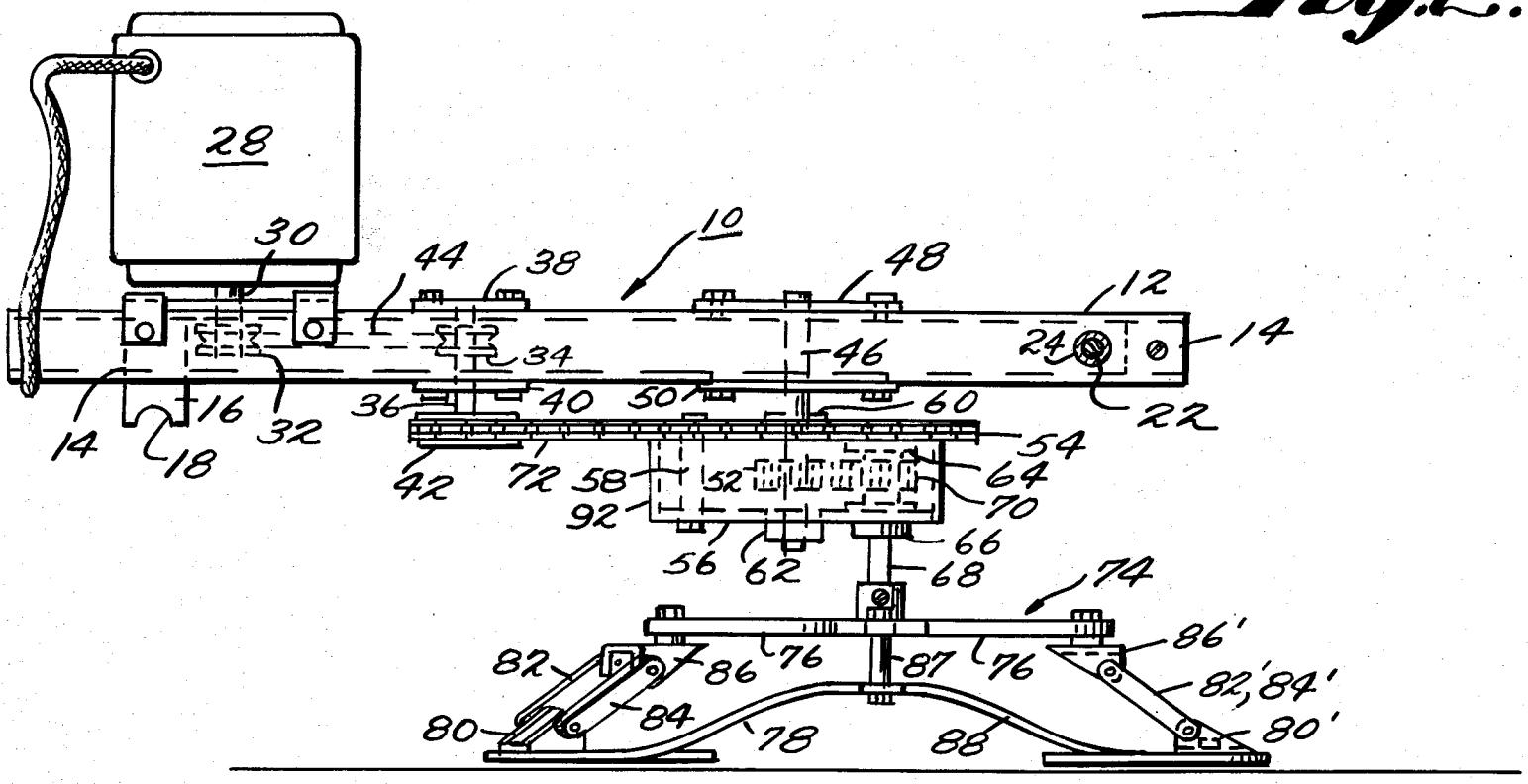

The invention now will be described in greater detail with reference to the accompanying drawings wherein:

FIG. 1 is a perspective view of an illustrative embodiment of the invention in operative position with respect to a wheelbarrow; and FIG. 2 is a side elevational view of the mixer.

Referring to the drawings, the mixer comprises an elongated frame 10 formed, for example, by matching parallel lengths of aluminum channel 12 joined together adjacent their ends by cross-pieces 14. On of the cross-pieces is provided with a pair of downwardly extending spaced ears 16 each having a notch 18 therein to receive the rear edge of a wheelbarrow 20 thereby orienting one end of the frame with respect to the wheelbarrow. Adjacent the opposite end of frame 10 the channels 12 are provided with apertures to receive an arrangement of telescoping lengths of metallic stock. Preferably, this arrangement comprises a section of round stock 22 bridging the channels 12 and projecting outwardly through apertures on opposite sides of the frame. A pair of tubular members 24 slip over the projecting ends of the round stock, the lengths of members 24 being sufficient to span the width of any conventional wheelbarrow. Accordingly, by means of suitable clamps 26, the members 24 can be secured to the side edges of wheelbarrow 20 while the ears 16 are retained in contact with the wheelbarrow's rear edge by an additional clamp (not shown) which engages the associated cross-piece 14.

Frame 10 serves as a support for a motor 28 which is mounted on the frame adjacent the rear edge thereof. While an electric motor is illustrated, it will be appreciated that a gasoline-powered engine also may be employed. The motor 28 is provided with a downwardly extending output shaft 30 having a pulley 32 thereon at a location between channel members 12. An idler pulley 34 is positioned within frame 10 adjacent pulley 32. Pulley 34 is mounted on a shaft 36 supported by bearing plates 38 and 40 secured to frame 10. The shaft 36 projects downwardly below the frame and has a sprocket 42 affixed thereto at its lowermost end. A belt 44 joins pulleys 32 and 34 whereby rotation of pulley 32, resulting from energization of the motor, is translated by the belt, idler pulley 34 and shaft 36 into rotation of sprocket 42. By appropriate selection of the sizes of the pulleys, the desired rotational speed of shaft 36 is established.

The frame 10 also serves as a mounting for a stationary shaft 46 which is secured to plates 48 and 50 fastened to the frame. Shaft 46 projects downwardly from the frame and is provided with a stationary gear 52 intermediate its ends. The projecting portion of the shaft 46 serves as a support for a drive assembly which rotates with respect to shaft 46. The assembly comprises a sprocket 54 and a plate 56 which are held together in spaced relationship by conventional bolt and spacer means 58 (only one of which is shown for convenience of illustration). Suitable bearings 60 and 62 are provided at the locations where shaft 46 passes through sprocket 54 and plate 56. The sprocket and plate serve as supports for bearings 64 and 66 through which an additional shaft 68 passes. The axis of shaft 68 is parallel to that of shaft 46 and is offset with respect thereto. A gear 70 is secured to sahft 68 intermediate the bearings 64 and 66 and is arranged to mesh with stationary gear 52. The relationship of gears 52 and 70 is selected in order to impart a desired rotational speed to shaft 68. The drive assembly is operated by a chain 72 passing about sprockets 42 and 54.

Shaft 68 projects downwardly below the level of plate 56. A blade support member 74 is secured to the end of shaft 68. Member 74 includes four outwardly projecting arms 76, adjacent arms being disposed at an angle of approximately 90° with respect to one another. Arms 76 serve to support a pair of mixing blades, as now will be described.

A first blade 78 is joined at its opposite ends to the extremities of a pair of adjacently positioned arms 76. More particularly, blade 78, at a free end thereof, is provided with an upwardly extending U-shaped member 80 having a pair of parallel connecting links 82 and 84 journalled thereto. One of the arms 76 of said pair has releasably connected thereto a downwardly extending U-shaped member 86 to which the opposite ends of links 82 and 84 are pivotally connected. The opposite end of blade 78 is pivotally connected by a spacer 87 to the outer end of the arm 76 adjacent that to which member 86 is joined. Spacer 87 is dimensioned such that the end of blade 78 connected thereto is elevated with respect to the opposite end of the blade 78.

A second blade 88 is joined to the remaining adjacent pair of arms 76 in the same manner as just described with respect to blade 78. The corresponding elements used to support blade 88 are designated as 80', 82', 84', 86' and 87'. The members 86 and 86' are joined to respective arms 76 diagonally opposite to one another, these arms being provided with radially extending slots 90 and 90' to permit adjustment of the positions of the ends of the blades so as to adjust the mixing area of the blades. The pivotally connected links 82, 84, 82' and 84' allow the blades 78 and 88 to automatically accommodate wheelbarrows of varying depths.

The structure is completed by enclosing the main drive assembly with a housing 92. The frame 10 beyond motor 28 is provided with a cover 94 having a handle 95 at an end thereof to facilitate lifting of the device (the cover and handle being omitted from FIG. 2 for convenience of illustration). The exterior or housing 94 has clips 96 attached thereto in order to receive the tubular members 24 when the mixer is being stored or transported.

Now that the structure of the mixer has been set forth, the manner of operation will be described. With the mixer supported on the edges of the wheelbarrow and the motor 28 energized, rotation of shaft 30 is translated by pulley 32, belt 44 and pulley 34 into rotation of shaft 36 and sprocket 42. As sprocket 42 rotates, the chain 72 causes sprocket 54 to rotate, thereby moving gear 70 with respect to stationary gear 52. As a result, gear 70 rotates, causing shaft 68 to turn. The rotation of shaft 68 is translated through arms 76 and the support arrangement for the blades to turn blades 78 and 88. Simultaneously, the movement of shaft 68 concentrically with respect to the axis of shaft 46 causes the blades to move in an orbital path as they turn. Consequently, the material within the wheelbarrow is thoroughly mixed.

The structure just described is lightweight and thus can be easily carried. This not only facilitates its removal to provide access to mixed material within the wheelbarrow, but it also allows the mixer to be easily moved from place to place. In view of the features of the adjustability of the blades and the floating arrangement by which the blades are suspended from arms 76, the mixer is suitable for use with wheelbarrows of various widths and depths. The rotational movement of the blades while describing an orbital path achieves uniform blending of the mix.

While the device has been described as being particularly adapted for use with a wheelbarrow, it should be appreciated that it may also be employed with other mixing containers such as drums, tubs, etc.

I claim:

1. A mixer adapted to rest on an edge of a container holding materials to be blended, said mixer comprising:

a frame;

means provided at one end of said frame for engaging the container edge at a first location;

means projecting outwardly from opposite sides of the frame adjacent the opposite end thereof, said projecting means being adapted to engage the container edge at additional locations;

a motor mounted on the frame;

a drive assembly rotatably supported by said frame in spaced relationship with respect to said motor and a bottom of said container, said drive assembly being rotatable about a first axis and including a shaft rotatable about a second axis parallel to said first axis;

means coupling the motor to said drive assembly for translating operation of the motor into rotation of the drive assembly about said first axis and displacement of said shaft in a path concentric with respect to said first axis, said shaft simultaneously rotating about the second axis; and a blade assembly secured to an end of said shaft and positioned between the drive assembly and the bottom of said container, said blade assembly being dimensioned to project outwardly from the shaft a distance greater than the distance between said first and second axes whereby rotation and displacement of the shaft results in turning of the blade assembly and movement of the blade assembly in an orbital path to encompass the area beneath said drive assembly.

2. A mixer as set forth in claim 1, wherein the engaging means at said one end of the frame comprises a pair of spaced members formed to receive the edge of the container thereby orienting the frame with respect to the container.

3. A mixer as set forth in claim 1, wherein said means projecting from opposite sides of the frame comprise a pair of arms which are removably coupled to said frame.

4. A mixer as set forth in claim 1, wherein said drive assembly is supported for rotation about an additional shaft non-rotatably secured to said frame along the first axis, said additional shaft having a first gear fixedly secured thereto, said gear engaging a second gear secured to the first-mentioned shaft to impart rotation to the first-mentioned shaft when it is displaced in said concentric path about the first axis.

5. A mixer as set forth in claim 1, wherein said coupling means includes means for converting the operating speed of the motor to the desired rotational speed of the drive assembly.

6. A mixer adapted to rest on an edge of a container holding materials to be blended, said mixer comprising:

a frame;

means provided at one end of said frame for engaging the container edge at a first location;

means projecting outwardly from opposite side of the frame adjacent the opposite end thereof, said projecting means being adapted to engage the container edge at additional locations;

a motor mounted on the frame;

a drive assembly rotatably supported by said frame in spaced relationship with respect to said motor, said drive assembly being rotatable about a first axis and including a shaft rotatable about a second axis parallel to said first axis;

means coupling the motor to said drive assembly for translating operation of the motor into rotation of the drive assembly about said first axis and displacement of said shaft in a path concentric with respect to said first axis, said shaft simultaneously rotating about the second axis; and a blade assembly secured to said shaft whereby rotation and displacement of the shaft results in turning of the blade assembly and movement of the blade assembly in an orbital path, said blade assembly including a blade support member secured to the end of said shaft, and means joining at least one blade to said blade support member, said joining means comprising a flexible connection between a first point on said blade and a first point on the blade support member and a non-flexible connection between a second point on said blade and another point on said blade support member whereby said first point of the blade floats with respect to the second point.

7. A mixer as set forth in claim 6, wherein said flexible connection comprises at least one connecting link pivotally connected between said blade and the blade support member.

8. A mixer as set forth in claim 6, wherein said flexible connection is adjustably secured to at least one of the blades and the blade support member in order to vary the position of the blade with respect to the blade support member.

9. A mixer as set forth in claim 8, wherein the flexible connection is adjustably secured along a radially extending slot in said support member.

10. A mixer as set forth in claim 6, wherein said blade support member comprises a plurality of arms extending in an outwardly direction with respect to said shaft, said first and second points on respective blades being joined to alternate pairs of said arms.

11. A mixer adapted to rest on an edge of a container holding materials to be blended, said mixer comprising:

a frame;

means provided at one end of said frame for engaging the container edge at a first location;

means projecting outwardly from opposite sides of the frame adjacent the opposite end thereof, said projecting means being adapted to engage the container edge at additional locations;

a motor mounted on the frame;

a drive assembly supported for rotation about a shaft non-rotatably secured to the frame along a first axis, said shaft having a first gear fixedly secured thereto, the drive assembly including: an additional shaft rotatable about a second axis parallel to said first axis and a second gear secured to said additional shaft and engaging the first gear;

means coupling the motor to said drive assembly for translating operation of the motor into the rotation of the drive assembly about said first axis and displacement of said additional shaft in a path concentric with respect to said first axis whereby the second gear moves with respect to the first gear to impart rotating to said additional shaft, said coupling means including means for converting the operating speed of the motor to the desired rotational speed of the drive assembly; and a blade assembly which includes: a blade support member secured to said additional shaft, at least one blade, and means joining said blade to the blade support member, said joining means comprising at least one connecting link pivotally connected between first points on said blade and the blade support member and a non-flexible connection between second points on said blade and the blade support member whereby said first point on the blade floats with respect to the second point on the blade, said connecting link being adjustably secured along a radially extending slot in said support member in order to vary the position of the blade with respect to the blade support member, said blade assembly being responsive to rotation and displacement of the additional shaft so as to move in an orbital path while simultaneously turning.

* * * * *